US007617880B2

(12) United States Patent
Loughlin

(10) Patent No.: US 7,617,880 B2
(45) Date of Patent: Nov. 17, 2009

(54) ANCHOR ASSEMBLY FOR SLICKLINE SETTING TOOL FOR INFLATABLES

(75) Inventor: Michael J. Loughlin, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 156 days.

(21) Appl. No.: 11/975,860

(22) Filed: Oct. 22, 2007

(65) Prior Publication Data

US 2009/0101362 A1 Apr. 23, 2009

(51) Int. Cl.
*E21B 23/01* (2006.01)

(52) U.S. Cl. ..... 166/387; 166/120; 166/212

(58) Field of Classification Search ..... 166/382, 166/387, 120, 140, 187, 212
See application file for complete search history.

(56) References Cited

U.S. PATENT DOCUMENTS

| | | | | |
|---|---|---|---|---|
| 2,942,666 | A | 6/1960 | True et at | |
| 3,032,116 | A | 5/1962 | Barry | |
| 3,057,406 | A | 10/1962 | Patterson et al. | |
| 3,083,774 | A | 4/1963 | Peters et al. | |
| 3,398,796 | A * | 8/1968 | Fisher, Jr. et al. | 166/120 |
| 5,331,607 | A | 7/1994 | Roessler | |
| 5,404,946 | A | 4/1995 | Hess | |
| 6,341,654 | B1 | 1/2002 | Wilson et al. | |
| 6,345,669 | B1 | 2/2002 | Buyers et al. | |
| 6,752,205 | B2 | 6/2004 | Kutac et al. | |
| 6,886,631 | B2 | 5/2005 | Wilson et al. | |
| 6,915,845 | B2 | 7/2005 | Leising et al. | |
| 6,935,423 | B2 * | 8/2005 | Kusmer | 166/217 |
| 7,172,028 | B2 * | 2/2007 | Barbee et al. | 166/383 |
| 2002/0032126 | A1 * | 3/2002 | Kusmer | 507/100 |
| 2003/0221830 | A1 | 12/2003 | Leising et al. | |
| 2004/0020644 | A1 | 2/2004 | Wilson et al. | |
| 2004/0055749 | A1 * | 3/2004 | Lonnes et al. | 166/298 |
| 2005/0126791 | A1 | 6/2005 | Barbee et al. | |
| 2006/0081380 | A1 | 4/2006 | Hoffman et al. | |
| 2007/0107913 | A1 * | 5/2007 | Arnold et al. | 166/387 |
| 2007/0151735 | A1 * | 7/2007 | Ravensbergen et al. | 166/308.1 |
| 2008/0190605 | A1 * | 8/2008 | Clapp et al. | 166/250.17 |
| 2008/0230235 | A1 * | 9/2008 | Loughlin | 166/387 |

OTHER PUBLICATIONS

Technical Design's Stroking Pump, Technical Design, p. 1.
TAM SlikPak flyer, TAM International, pp. 1-4.
TAM SlikPak flyer, TAM International, pp. 1-2.

* cited by examiner

*Primary Examiner*—Shane Bomar
(74) *Attorney, Agent, or Firm*—Greenberg Traurig LLP; Anthony F. Matheny

(57) ABSTRACT

An anchor assembly for use in downhole slickline strings to set wellbore inflatables comprises, in one specific embodiment, an upper mandrel, an upper piston, radially extendable slips, a release piston in sliding engagement with a release mandrel, and a lower housing in sliding engagement with a lower mandrel. Fluid entering a bore of the anchor assembly forces the upper piston downward and extends the anchors. Thereafter, the slickline is reciprocated to pump fluid down the bore of the anchor assembly into the inflatable to prevent premature release of the inflatable. As the inflatable inflates, the lower housing is pulled downward along the lower mandrel until the inflatable is fully inflated. At a predetermined pressure after inflation of the inflatable, the anchors are retracted by actuation of the release piston so that the anchor assembly can be retrieved.

21 Claims, 9 Drawing Sheets

ANCHOR ASSEMBLY FOR SLICKLINE SETTING TOOL FOR INFLATABLES

BACKGROUND

1. Field of Invention

The invention is directed to anchor assemblies for slickline setting tools for downhole inflatables such as packers and bridge plugs. In particular, the invention is directed to anchor assemblies capable of providing resistance to slickline pumps so the slickline pumps can be reciprocated and the inflatables can be inflated.

2. Description of Art

Downhole inflatable devices such as bridge plugs and packers are well known in the industry, each having been extensively used over a substantial number of years. While bridge plugs and packers are distinct devices, for purposes of this application, the term "inflatables" refers to bridge plugs and packers, as well as any other downhole well device that is set through inflation.

Inflatables can be set within a wellbore using a slickline that is reciprocated upward and downward to reciprocate a pump that is part of the downhole string connected to the slickline. The pump forces fluid, e.g., wellbore fluid, into the inflatable causing the inflatable to expand and set within the wellbore. In order for the slickline to exert sufficient force to reciprocate the pump, the slickline first must be anchored within the wellbore. By anchoring the slickline, resistive force is provided so that the slickline can pull upward and push downward with the weight of the string to reciprocate the pump and, thus, inflate the inflatable. Because the slickline can inflate the inflatables by mechanical reciprocation, the slickline is not required to be capable of carrying electricity or otherwise carry electrical sources such as batteries to set the anchor assembly.

SUMMARY OF INVENTION

Broadly, anchor assemblies for use in downhole tool strings for setting an inflatable within a wellbore using a slickline comprise an anchor setting sub-assembly, an inflation sub-assembly disposed below the anchor setting sub-assembly, and an anchor release sub-assembly disposed below the inflation sub-assembly. In one embodiment, the anchor setting sub-assembly is actuated by hydrostatic pressure within the wellbore. The inflation sub-assembly and the anchor release sub-assembly, however, are actuatable by at predetermined fluid pressures, referred to as pump pressures or applied pressures or applied fluid pressures formed within a bore of a mandrel of the anchor assembly. For example, the inflation sub-assembly comprises a valve that is initially closed but is moved to an opened position by an applied pressure, i.e., a pressure that is created by pumping fluid into the bore of the mandrel. Thus, in the embodiment in which hydrostatic pressure actuates the anchor setting sub-assembly, the applied pressure that actuates the valve is greater than the hydrostatic pressure.

Likewise, the anchor release sub-assembly comprises a pump pressure actuatable mandrel release that is also actuated by an applied pressure. The release member is actuated at an applied pressure that is greater than the applied pressure that actuates the valve of the inflation sub-assembly. The mandrel release, when actuated, retracts the anchors that were previously set so that, after the inflatable is set and released by the anchor assembly, the downhole tool string comprising the anchor assembly can be removed from the wellbore.

In one embodiment, the anchor assembly is used to set the inflatable by running a downhole tool string on a slickline into a wellbore. In one particular embodiment, the downhole tool string comprises a pump, a trigger, an anchor assembly, and an inflatable, the pump being disposed above the trigger, the trigger being disposed above the anchor assembly, and the anchor assembly being disposed above the inflatable. The trigger is actuated to allow fluid to enter the anchor assembly and actuate the anchor assembly to radially expand an anchor from an anchor run-in position to an anchor set position in which the anchor engages an inner wall surface of the wellbore. Reciprocation of the slickline activates the pump to pump fluid through the trigger and into the anchor assembly to actuate a valve operatively disposed within the anchor assembly. Actuation of the valve allows fluid to flow into the inflatable where it inflates the inflatable due to additional reciprocation of the slickline to pump fluid through the trigger, through the anchor assembly, and into the inflatable until the inflatable is set within the wellbore. Additional reciprocation of the slickline causes the applied pressure within the anchor assembly to increase until the mandrel release is actuated causing the anchor to retract from the anchor set position to the anchor retracted position.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
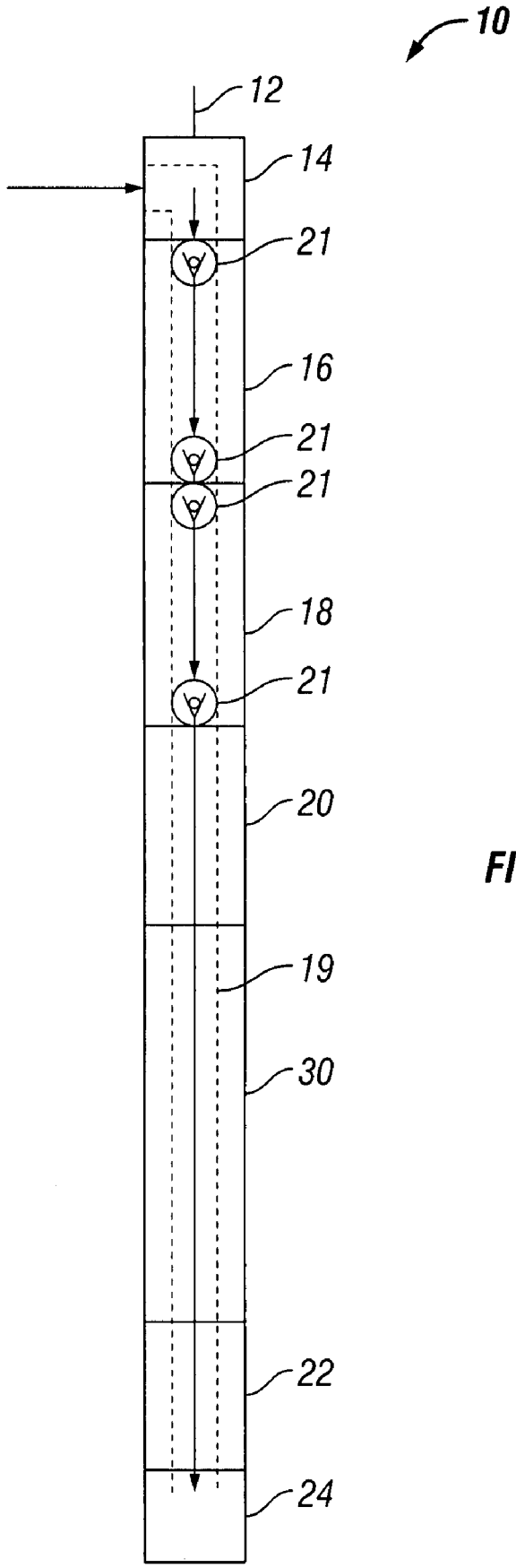
FIG. 1 is a schematic view of a downhole tool string having one embodiment of the anchor assembly disclosed herein.
Figure 2A:
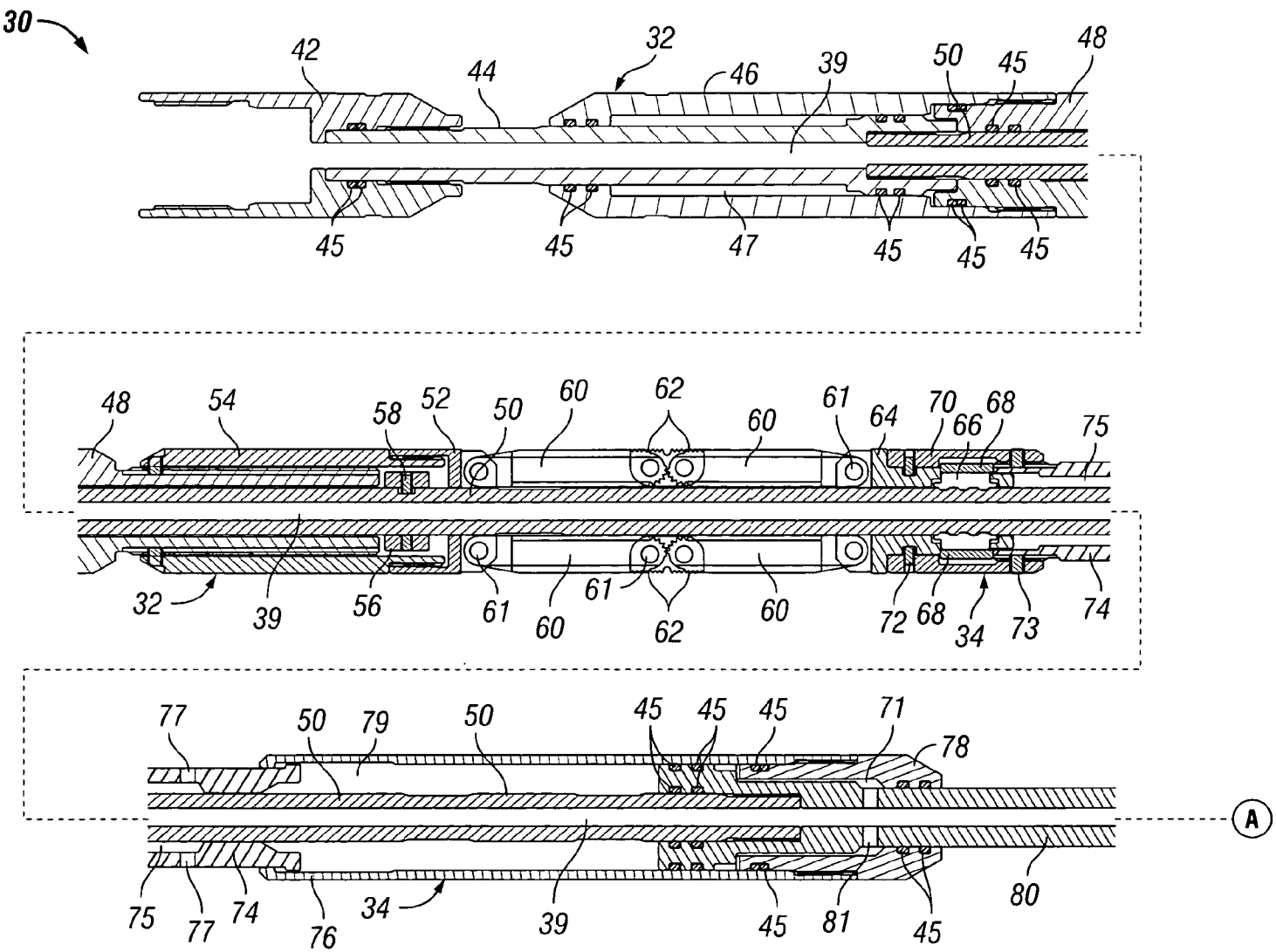
FIGS. 2A-2B is a partial cross-sectional view of one specific embodiment of an anchor assembly disclosed herein shown in the run-in position.
Figure 2B:
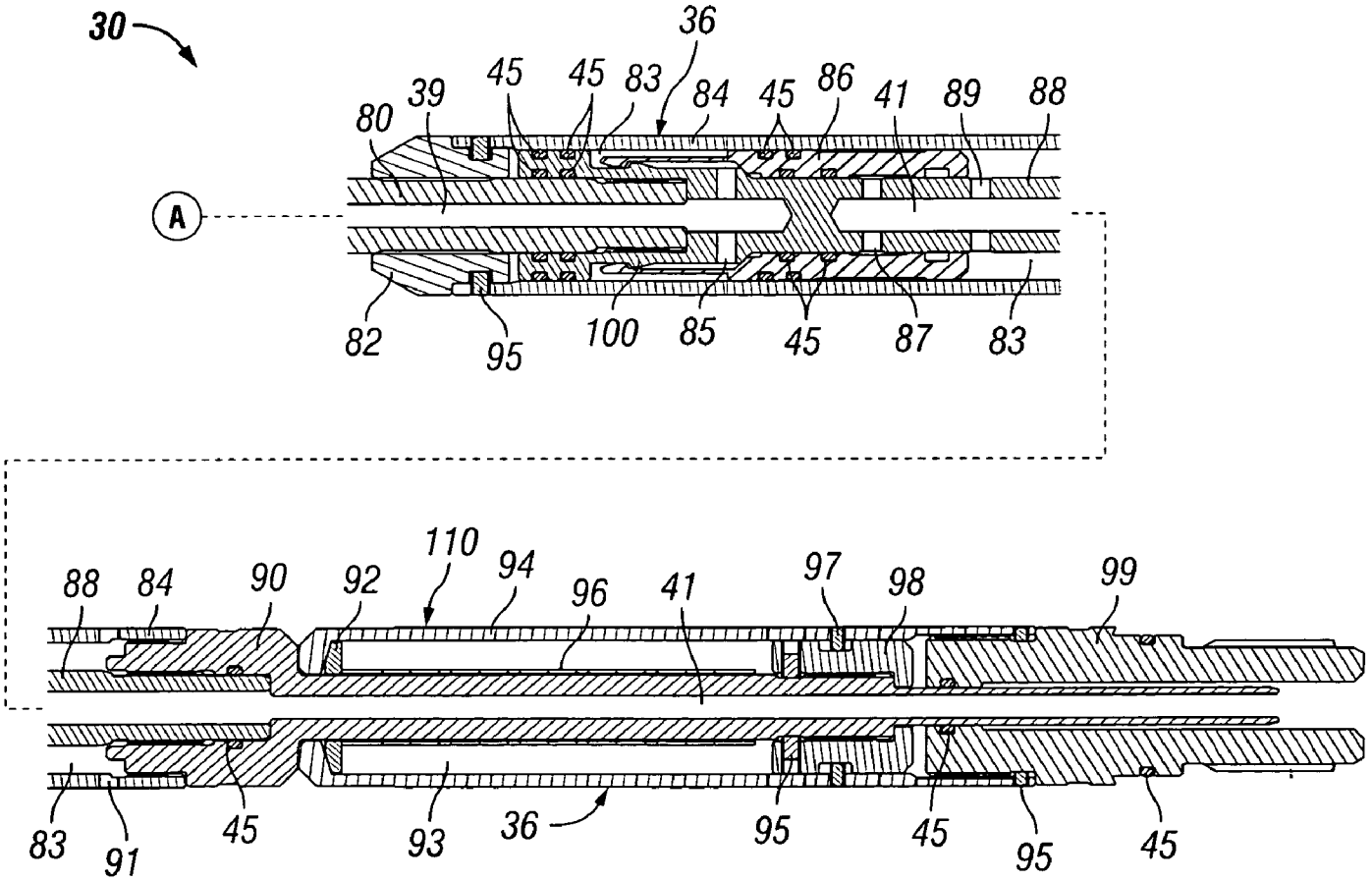

Referring now to FIG. 1, downhole tool string 10 is shown schematically as comprising slickline 12, filter 14, low pressure pump 16, high pressure pump 18, trigger 20, anchor assembly 30, hydraulic disconnect 22, and inflatable 24 such as a bridge plug or packer. Filter 14 and inflatable 24 are in fluid communication with each other through bore 19. Filter 14 prevents debris and other particulate matter within the wellbore (not shown) from being allowed to flow into bore 19 and, thus, into low pressure pump 16, high pressure pump 18, trigger 20, anchor assembly 30, hydraulic disconnect 22, and inflatable 24. Filter 14 may be any device or method known to persons of ordinary skill in the art. In one specific embodiment, filter 14 is a screen.

Low pressure pump 16 and high pressure pump 18 for use with slickline 12 are known in the art. In general, low pressure pump 16 and high pressure pump 18 are reciprocating pumps having pistons (not shown) disposed within them. The pistons of low pressure pump 16 and high pressure pump 18 are activated by pulling upward on slickline 12 followed by pushing downward on slickline 12. The step of pushing downward on slickline 12 is understood to include releasing the tension on slickline 12 so that the weight of downhole tool string 10 pushes or forces downward the pistons of low pressure pump 16 and high pressure pump 18. One-way check valves 21 are disposed within low pressure pump 16 and high pressure pump 18 so that the fluid being pumped down downhole tool string 10 allows pressure to build up below pumps 16, 18 without allowing the pressure to escape upward.

Trigger 20 can be any type of setting tool known in the art. For purposes of the embodiments described herein, trigger 20 is a valve having an electronic circuit operated by a timer such as those available from Welbor Technology, Inc., located in Houston, Tex. The timer of trigger 20 is set to open fluid flow from high pressure pump 18 through trigger 20 and into anchor assembly 30. After opening, wellbore fluid is permitted to flow through trigger 20 and into anchor assembly 30. Accordingly, the timer can be customized to actuate at a predetermined time calculated based upon when the requisite pressure will be reached for initially actuating the anchors 60 (FIGS. 2A, 3A, 4A, and 5A) of anchor assembly 30 as discussed in greater detail below.

In an alternative embodiment, trigger 20 may comprise a rupture disk (not shown) that breaks when hydrostatic pressure acting on the rupture disk reaches a predetermined level, generally equal to or greater than the predetermined level need to actuate anchor assembly 30 to initially set anchors 60 as discussed in greater detail below. Rupture disks are known in the art. Upon breaking of the rupture disk, wellbore fluid is permitted to flow into bore 19.

As illustrated by the arrows in FIG. 1, in operation of downhole tool string 10 fluid, such as wellbore fluid (not shown), flows into downhole tool string 10 and down bore 19 to ultimately inflate inflatable 24. As discussed in greater detail below, wellbore fluid enters downhole tool string 10 through filter 14 and flows through low pressure pump 16 and high pressure pump 18 where trigger 20 prevents the wellbore fluid from entering into anchor assembly 30 until trigger 20 is activated. After activation of trigger 20, the wellbore fluid flows into anchor assembly 30. In so doing, anchor assembly 30 actuates to engage the inner wall surface of the wellbore to secure anchor assembly 30 and, thus, downhole tool string 10 to the inner wall surface of the wellbore. Because downhole tool string 10 is now secured to the inner wall surface of the wellbore, sufficient resistance is provided to reciprocate low pressure pump 16 and high pressure pump 18 in series with low pressure pump 16 initially being reciprocated to build up pressure within bore 19 to inflate inflatable 24. By reciprocating low pressure pump 16 and high pressure pump 18, fluid pressure within bore 19 increases to further drive anchor assembly 30 into the inner wall surface of the wellbore and to pump fluid into inflatable 24 to inflate inflatable 24 until it performs the function for which it is designed, e.g., isolate the wellbore.

Referring now to FIGS. 2A-4B, in one particular embodiment anchor assembly 30 comprises three sub-assemblies: anchor setting sub-assembly 32, anchor release sub-assembly 34, and inflation sub-assembly 36. Anchor setting sub-assembly 32 is releasably connected to top sub 42 to facilitate connection of anchor assembly 30 to additional equipment such as trigger 20 (FIG. 1). Inflation sub-assembly 36 is releasably connected to bottom sub 99 to facilitate connection of anchor assembly 30 to additional equipment such as hydraulic disconnect 22 (FIG. 1). Anchor assembly 30 includes bore 39 and lower bore 41. Upper bore 39 is initially isolated from lower bore 41 by inflation valve sleeve 86 (discussed below). Upper bore 39 is at atmospheric pressure during run-in (FIGS. 2A-2B) and is isolated from lower bore 41 by a valve such as inflation valve sleeve 86, discussed in greater detail below. As also discussed in greater detail below, lower bore 41 is in fluid communication with the wellbore environment through vent port 91 and port 89 so that, during run-in, lower bore 41 is at hydrostatic, or wellbore, pressure. As a result, anchor assembly 30 is biased toward the run-in position to prevent anchors 60 from setting prematurely. Due to a valve isolating lower bore 41 from upper bore 39, actuation of the valve places lower bore 41 in fluid communication with upper bore 39 so that fluid is permitted to flow all the way through anchor assembly 30 to inflate inflatable 24 (FIG. 1).

Anchor setting sub-assembly 32 comprises upper mandrel 44, piston housing 46, spacing adapter 48, inner mandrel 50, upper anchor connector 52, adjustable spacer nut 54, shear screw ring 56 with shear screw 58 dispose therein and releasably connected to inner mandrel 50, anchors 60 having slip surfaces 62 for engaging the inner wall surface of the wellbore (not shown), and lower anchor connector 64. Although many different types of slips 62 are known in the art and can be used with anchor assembly 30, in one specific embodiment, slips 62 include wickers for "biting" into the inner wall surface of the wellbore. Seals 45 are disposed throughout anchor setting sub-assembly 32 to reduce leakage between components. Anchors 60 are connected to upper anchor connector 52, to each other, and to lower anchor connector 64 by anchor pins 61 that, as discussed in greater detail below, provide a pivot point to facilitate extension and retraction of anchors 60 during operation of anchor assembly 30.

Piston housing 46 includes chamber 47 formed between an outer wall surface of upper mandrel 44 and an inner wall surface of piston housing 46. Chamber 47 is at atmospheric pressure. Piston housing 46 is in sliding engagement along the outer wall surface of upper mandrel 44 and engages a shoulder on spacing adapter 48. Spacing adapter 48 is fitted within a bore of adjustable spacer nut 54. Inner mandrel 50 engages a lower end of upper mandrel 44 and is disposed within a bore of spacing adapter 48, adjustable spacer nut 54, upper anchor connector 52, anchors 60, lower anchor connector 64, and the bores of certain components of anchor release sub-assembly 34. Inner mandrel 50 includes shear screw ring 56 along its outer wall surface and held in place by shear screw 58. Shear screw ring 56 is disposed below spacing adapter 48 in a cavity formed by the bore of adjustable spacer nut 54.

Anchor setting sub-assembly 32 is operatively connected to anchor release sub-assembly 34 by shear ring retainer 70 held in place by shear screws 72 and set screws 73. Anchor release sub-assembly 34 comprises mandrel release member 66, pull release ring 68, shear ring retainer 70 having shear screw 72 disposed therein and connected to lower anchor connector 64, release sleeve adapter 74, release sleeve 76, release piston 78, and release mandrel 80. As shown in FIGS. 2A-4B, mandrel release member 66 comprises a dog having a profile reciprocal to a profile on the outer wall surface of inner mandrel 50. As discussed in greater detail below, mandrel release member 66 maintains anchors 60 in their set position by preventing lower anchor connector 64 from moving downward until inflatable 24 (FIG. 1) is set within the wellbore.

Release sleeve adapter 74 forms chamber 75 between the outer wall surface of inner mandrel 50 and an inner wall surface of release sleeve adapter 74. Chamber 75 is in fluid communication with the wellbore environment, i.e., outside of anchor assembly 30, by vent port 77 so that chamber 75 is at hydrostatic pressure. Release sleeve 76 forms chamber 79 between the outer wall surface of inner mandrel 50 and an inner wall Surface of release sleeve 76.

Figure 4A:
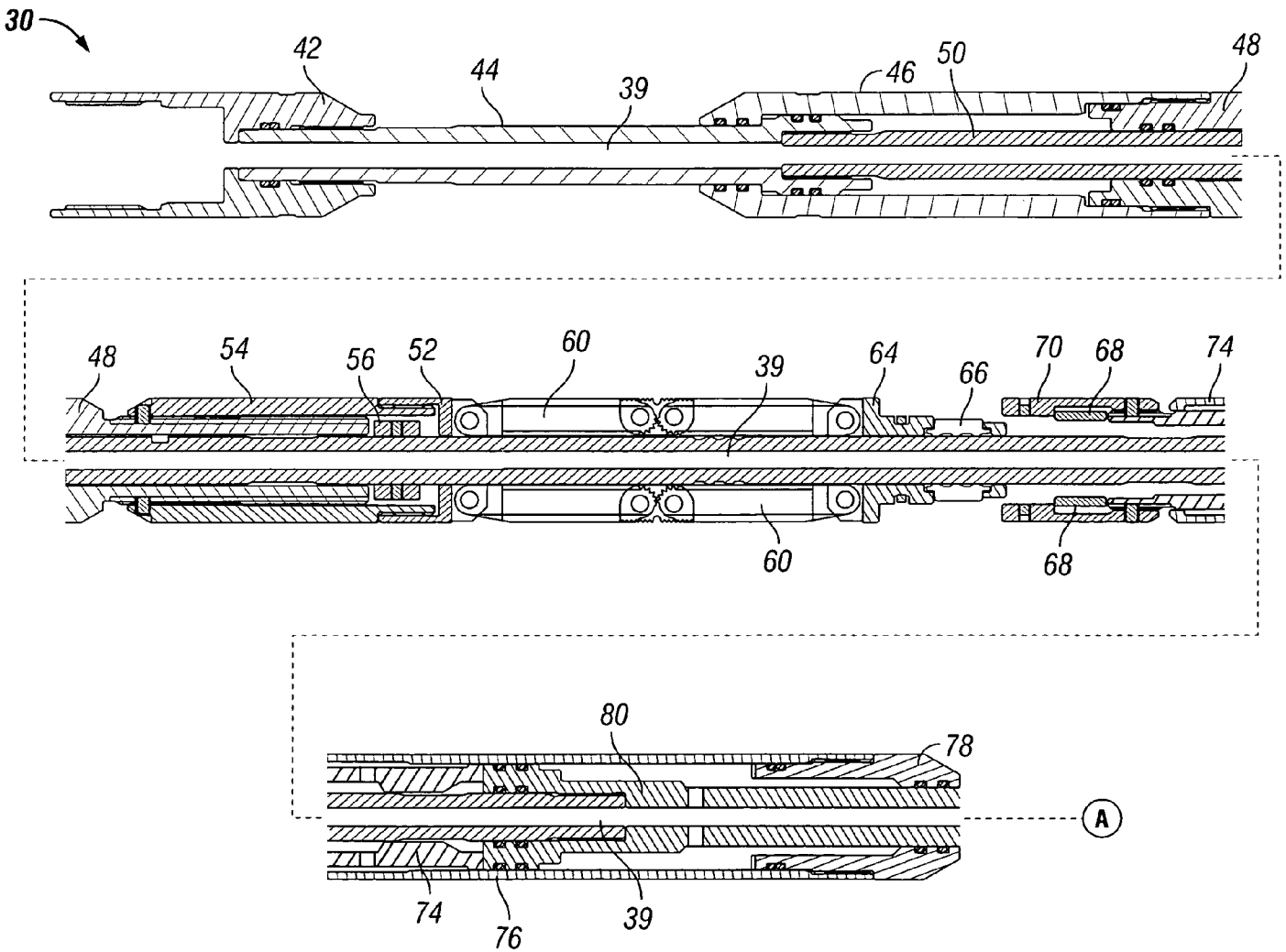
FIGS. 4A-4B is a partial cross-sectional view of the embodiment of the anchor assembly of FIGS. 2-3 shown in the run-out position, i.e., after an inflatable has been set and the downhole tool string has released the inflatable so that the downhole tool string can be retrieved from the wellbore.
Figure 4B:
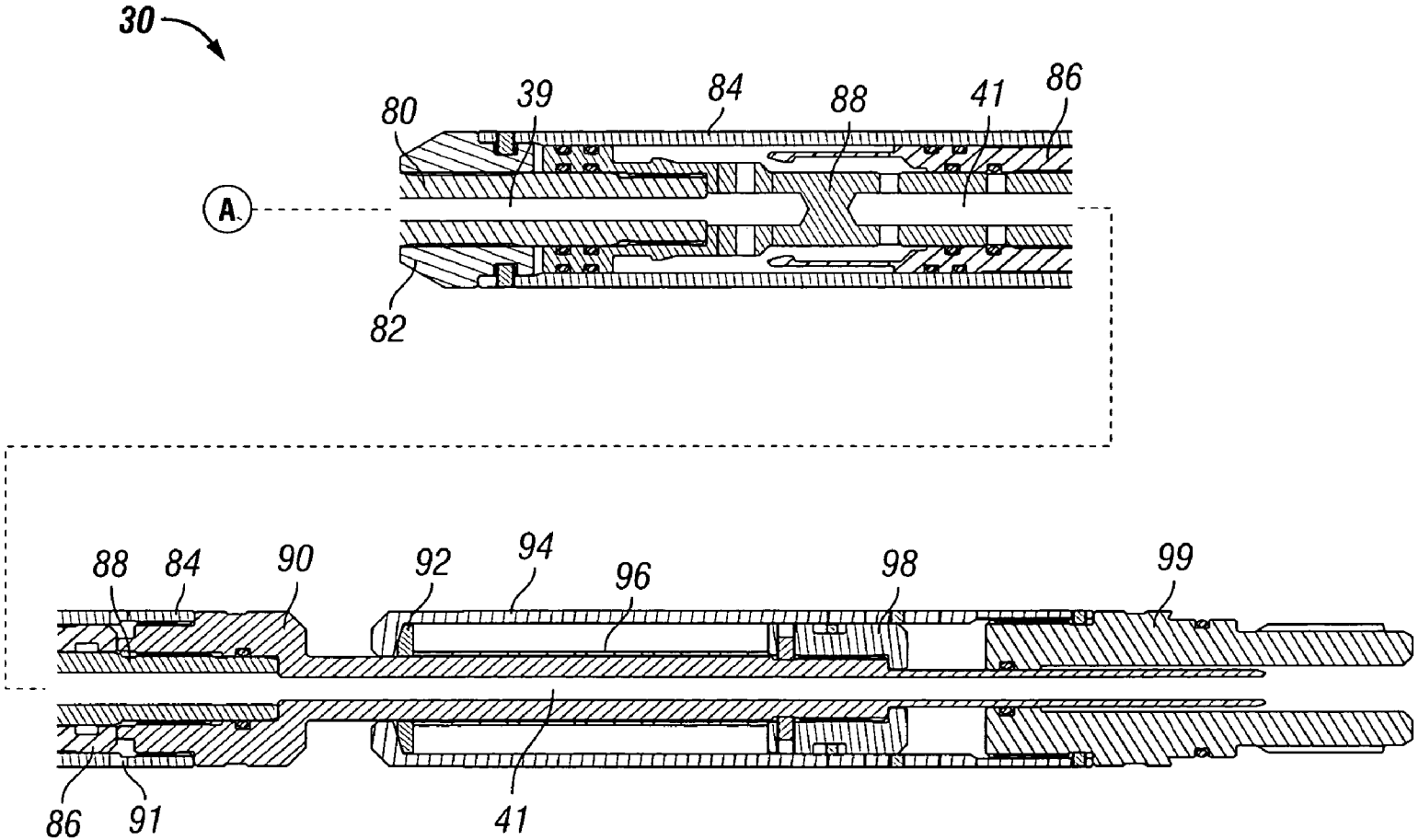

Release sleeve adapter 74 is in sliding engagement with an inner wall surface of release sleeve 76 so that anchors 60 can be retracted, i.e., disengaged from the inner wall surface of the wellbore to the position shown in FIGS. 4A-4B, by release sleeve adapter 74 being moved downward (FIG. 4A). In other words, movement of release sleeve adapter 74 downward actuates, in this embodiment frees, mandrel release member 66 from inner mandrel 50 which in turn allows lower anchor connector 64 and, thus, the lower end of anchors 60 to move downward along the outer wall surface of inner mandrel 50 so that anchors 60 pivot at anchor pins 61 and are retracted against inner mandrel 50 (FIG. 4A). Release sleeve adapter 74 includes a flanged portion on its lower end and release sleeve 76 includes an inner shoulder on its upper end to prevent release sleeve adapter 74 from sliding out of release sleeve 76, i.e., out of chamber 79.

Release piston 78 is in sliding engagement with an outer wall surface of release mandrel 80 and release mandrel 80 is in sliding engagement with the outer wall surface of inner mandrel 50. Release mandrel 80 also includes port 81 in fluid communication with chamber 71 formed by an inner wall surface of release piston 78 and an outer wall surface of release mandrel 80. Release piston 78 includes a shoulder for engaging release sleeve 76. Release mandrel 80 includes a shoulder for engaging release piston 78. Seals 45 are disposed throughout anchor release sub-assembly 34 to reduce leakage between components.

Referring now to FIGS. 2B, 3B, 4B, and 5B, inflation sub-assembly 36 comprises inflation valve ring 82, inflation valve housing 84 having vent port 91, inflation valve sleeve 86, inflation valve mandrel 88, lower mandrel 90, beveled bearing ring 92, compensator housing 94, and compensator nut 98 with shear screw 97 disposed therein and connected to compensator housing 94. Set screws 95 connect inflation valve ring 82 to inflation valve housing 84, compensator nut 98 to lower mandrel 90, and bottom sub 99 to compensator housing 94. Inflation sub-assembly 36 is operatively connected to anchor release sub-assembly 34 through release mandrel 80 being inserted through inflation valve ring 82 and placed within an upper portion of the bore of inflation valve mandrel 88.

Inflation valve sleeve 86 is shown in the embodiment of FIGS. 2A-4B as a collet releasably secured to a flanged shoulder 100 disposed on the outer wall surface of inflation valve mandrel 88. Chamber 83 is formed between the outer wall surface of inflation valve mandrel 88 and the inner wall surface of inflation valve housing 84. Inflation valve sleeve 86 is in sliding engagement with the inner wall surface of inflation valve housing 84 and the outer wall surface of inflation valve mandrel 88.

Inflation valve mandrel 88 includes upper port 85, middle port 87, and lower port 89. Initially, inflation sub-assembly 36 is in its closed position (FIG. 2B) so that fluid cannot flow between the upper bore 39 into lower bore 41 due to inflation valve sleeve 86. Inflation valve sleeve 86 thus isolates upper bore 39, which is at atmospheric pressure during run-in, from lower bore 41 which is at hydrostatic pressure during run-in. Due to inflation valve sleeve 86 being in the run-in position, fluid cannot be pumped down lower bore 41 to inflate inflatable 24 (FIG. 1). Additionally, because lower bore 41 is at hydrostatic pressure, the seals 45 disposed below upper bore 39 do not have to isolate pressure differentials between the hydrostatic pressure, which can be quite large, and atmospheric pressure.

Inflation valve housing 84 engages a shoulder disposed on lower mandrel 90 and the lower end of inflation valve mandrel 88 engages an inner shoulder disposed on lower mandrel 90. Lower mandrel 90 includes force compensator 110 comprising compensator housing 94 in sliding engagement along the outer wall surface of lower mandrel 90. Chamber 93 is formed between the inner wall surface of compensator housing 94 and the outer wall surface of lower mandrel 90. Disposed within chamber 93 is a compensation member. The compensation member is designed to compress as the inflatable inflates. In this manner, force compensator 110 allows bottom sub 99 to move downward as inflatable inflates and, thus, decreases its axially length along downhole tool string 10. In one embodiment, the compensation member comprises beveled bearing ring 92 and crush tube 96. Beveled bearing ring 92 facilitates crushing crush tube 96 as inflatable 24 (FIG. 1) is inflated so that compensator housing 94 can move downward as inflatable 24 inflates. Therefore, as discussed in greater detail below, crush tube 96 facilitates maintenance of compensator housing 94 in an upper position along lower mandrel 90, yet is capable of being compressed by beveled bearing ring 92 as inflatable 24 inflates and forces compensator housing 94 to slide downward along the outer wall surface of lower mandrel 90.

To facilitate compression of crush tube 96, lower mandrel 90 engages an inner shoulder disposed on compensator nut 98. Compensator nut 98 is connected to lower mandrel 90 by set screw 95 and is releasably connected to compensator housing 94 by shear screw 97. Compensator housing 94 engages a shoulder on bottom sub 99 and set screw 95 secures compensator housing 94 to bottom sub 99. Seals 45 are disposed throughout inflation sub-assembly 36 to prevent leakage between components.

Suitable other compensation members include Belleville washers, also known as Belleville springs, coiled springs, and one or more shear screw without a crush tube.

In operation, downhole tool string 10 is assembled and run-in a wellbore to a desired depth. In so doing, hydrostatic pressure enters vent port 77 and vent port 91 so that the pressure within chamber 75 and chamber 83, respectively, as well as lower bore 41 through vent port 91 and port 89, is equalized with the wellbore, i.e., hydrostatic, pressure. Thus, all anchor assembly 30 components below inflation valve sleeve 86 are balanced with the wellbore pressure.

Figure 3A:
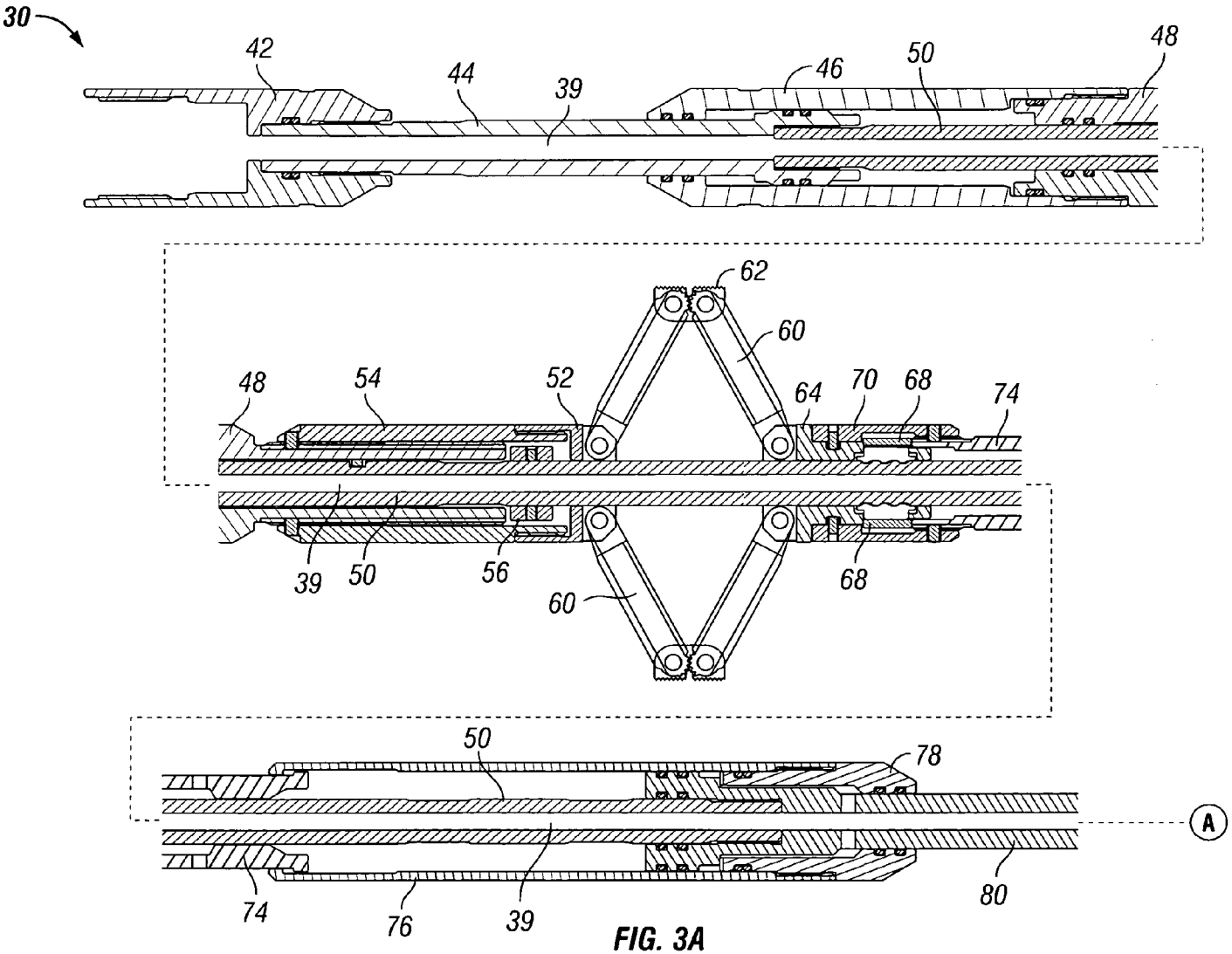
FIGS. 3A-3B is a partial cross-sectional view of the embodiment of the anchor assembly of FIG. 2 shown in the set position after fluid has started to be pumped through the downhole tool string so that the pressure from the pumped fluid is high enough to begin inflating an inflatable.

After disposing downhole tool string 10, trigger 20 is actuated or activated to permit fluid flow from the wellbore through trigger 20 and into anchor assembly 30. Actuation or activation of trigger 20 can use any mechanism or method to open fluid flow from the wellbore, through trigger, and into upper bore 39. The fluid, and its accompanying hydrostatic pressure, flows down upper bore 39, e.g., through the bore of upper mandrel 44, through the bore of inner mandrel 50, into the bore of release mandrel 80, through port 81, into chamber 71 of release piston 78, into the bore of inflation valve mandrel 88, and through upper port 85 into chamber 83 above inflation valve sleeve 86. As mentioned above, prior to fluid flowing into bore 39, e.g., into the bore of upper mandrel 44, through the bore of inner mandrel 50, into the bore of release mandrel 80, through port 81, into chamber 71 of release piston 78, into the bore of inflation valve mandrel 88, through upper port 85, and into chamber 83 above inflation valve sleeve 86, all of these areas were at atmospheric pressure so that piston housing 46 is forced to remain in the run-in position (FIG. 2A) because chamber 47 is also at atmospheric pressure so the two areas are equalized and movement of piston housing 46 is restricted. However, as hydrostatic pressure enters these areas, a pressure differential is created because the hydrostatic pressure is greater than the atmospheric pressure within chamber 47. Therefore, piston housing 46 is forced downward and slides along the outer wall surface of upper mandrel 44 from the run-in position (FIG. 2A) to the set position (FIG. 3A). In other words, hydrostatic pressure sets anchors 60, however, in this embodiment, it does not actuate or cause, by itself, any other component of anchor assembly 60 to be actuated.

Figure 3B:
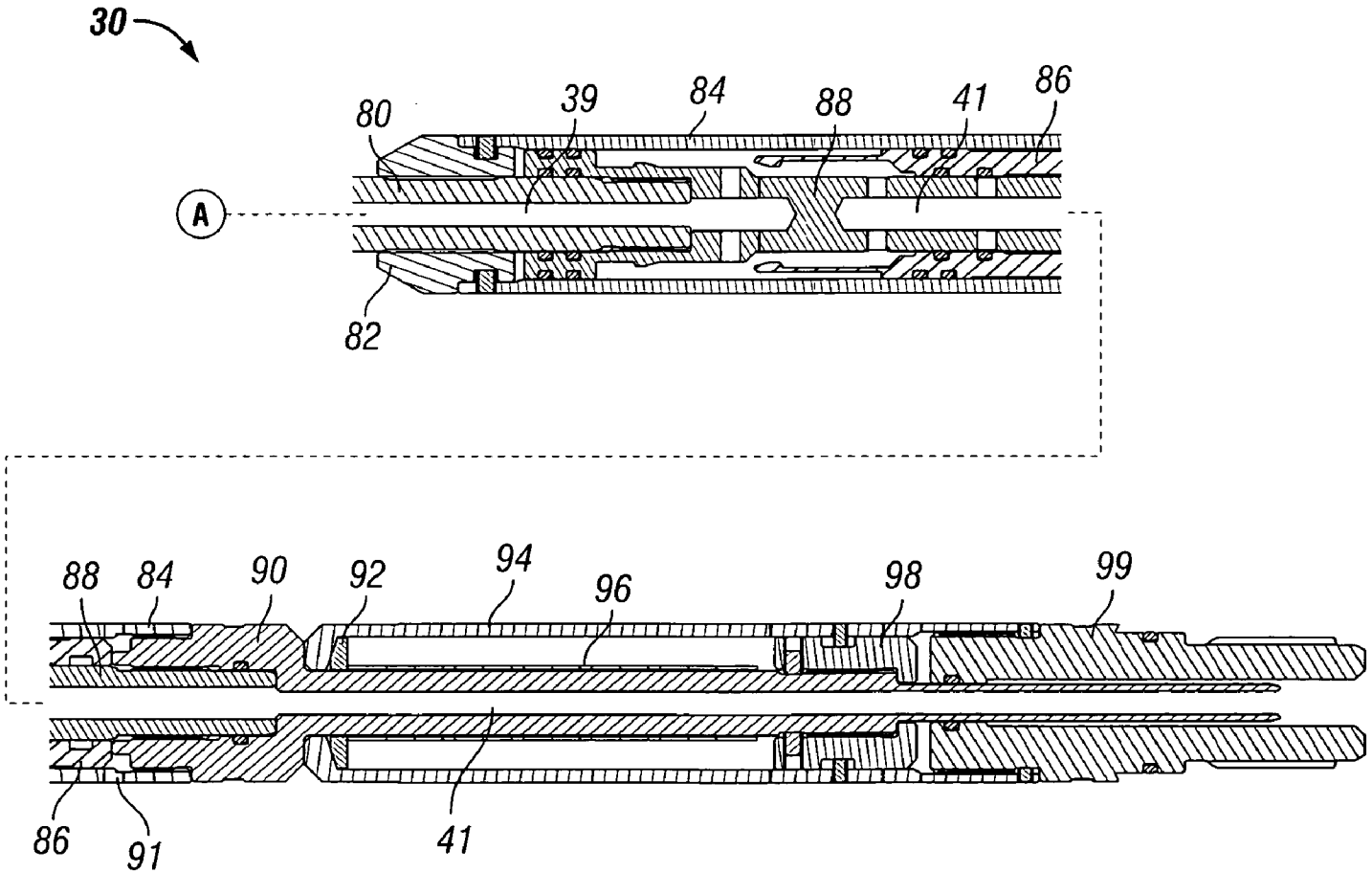

As illustrated in FIGS. 3A-3B, movement of piston housing 46 downward relative to inner mandrel 50, i.e., toward the right in FIGS. 2A-5B, due to hydrostatic pressure replacing atmospheric pressure within upper bore 39 of anchor assembly 30, forces spacing adapter 48 to also move downward relative to inner mandrel 50 and exert a force against shear screw ring 56. Although operation of anchor assembly 30 is discussed herein as having various "downward" movements, it is to be understood that downward movement includes situations in which one component moves upward, e.g., inner mandrel moves upward as one or more other component remains stationary or simultaneously moves downward. Thus, the movement of certain components in the operation of anchor assembly 30 are described herein as being "relative" to another component.

Upon reaching a sufficiently strong force against shear screw ring 56, shear screw 58 breaks so that spacing adapter 48 can continue to be forced downward relative to inner mandrel 50 by piston housing 46 which also forces adjustable spacer nut 54 and upper anchor connector 52 downward relative to inner mandrel 60 causing anchors 60 to extend or "buckle" radially outward, i.e., pivot at anchor pins 61, causing slips 62 to be set by engaging the inner wall surface of the wellbore. Thus, anchors 60 are moved from their run-in position (FIG. 2A) to their set position (FIG. 3A).

After anchors 60 are engaged with the inner wall surfaces, sufficient resistive force is provided by anchor assembly 30 so that slickline 12 can be pulled up and "pushed" downward, i.e., reciprocated, so that wellbore fluid is pumped through low pressure pump 16 and high pressure pump 18. It is to be understood that the act of "pushing" generally involves providing slack in slickline 12, i.e., decreasing tension in slickline 12, so that the weight of downhole tool string 10 above anchor assembly 30 will provide the "push" portion of reciprocation of low pressure pump 16 and high pressure pump 18.

As fluid is pumped down through upper bore 39 by low pressure pump 16 and, subsequently, high pressure pump 18, the fluid flows down the bore of upper mandrel 44, through the bore of inner mandrel 50, into the bore of release mandrel 80, into the bore of inflation valve mandrel 88, and through upper port 85 into chamber 83 above inflation valve sleeve 86. The pressure of the fluid being pumped down upper bore 39 is increased above hydrostatic pressure that is present below inflation valve sleeve 86. The pressure of this fluid is, therefore, referred to herein as "pump pressure" or "applied pressure."

As pump pressure builds up within the areas in fluid communication with upper bore 39, inflation valve sleeve 86 is actuated by the pump pressure, such as by forcing the collet fingers away from flange 100 on the outer wall surface of inflation valve mandrel 88 so that inflation valve sleeve 86 is forced downward relative to inflation valve mandrel 88 to force wellbore fluid out of chamber 83 through vent port 91 and to ultimately block vent port 91 (FIG. 3B). Thus, fluid being pumped down upper bore 39 flows from upper bore 39, through upper port 85 into the upper portion of chamber 83 above inflation valve sleeve 86, through middle port 87, and ultimately through lower port 89, and into lower bore 41. Because vent port 91 is now blocked by inflation valve sleeve 86, pump pressure of the fluid within bore 39 and now lower bore 41, can be further increased by reciprocation of low pressure pump 16 and/or high pressure pump 18.

After upper bore 39 is placed in fluid communication with lower bore 41, wellbore fluid can be pumped through lower mandrel 90 and into an inflatable (not shown in FIGS. 2A-5B) connected directly to bottom sub 99 or connected indirectly to bottom sub 99 such as through a hydraulic disconnect 22 (FIG. 1) disposed between bottom sub 99 and inflatable 24.

Wellbore fluid continues to be pumped through anchor assembly 30 by reciprocating lower pressure pump 16 and/or high pressure pump 18 as the case may be, to inflate the inflatable. As the inflatable inflates, the inflatable exerts a downward force on the entire downhole tool string 10. To reduce this force so inflatable 24 is not prematurely released or deflated, compensator housing 94 is pulled downward. As result, in one specific embodiment, compensator housing 94 compresses or crushes crush tube 96 between beveled bearing ring 92 and compensator nut 98 and pushes bottom sub 99 downward. Accordingly, large forces are prevented from developing between the anchor assembly 30 and the inflatable 24 during inflation which otherwise could pull release the inflatable, i.e., operate a deflation mechanism, or possibly part a connection between anchor assembly 30 and the inflatable.

After inflatable is sufficiently inflated so that the fluid pressure within anchor assembly 30 releases a certain threshold, more fluid begins to be pumped through port 81 of release mandrel 80 and into chamber 71 to act on release piston 78. Fluid flowing into chamber 71 causes release piston 78 to slide downward along the outer wall surface of release mandrel 80. Thus, chamber 71 enlarges in volume as more fluid is pumped down upper bore 39 of anchor assembly 30 until sufficient force acts downwardly on release piston 78 such that shear screw 72 breaks.

When shear screw 72 breaks, release piston 78 and, thus, shear ring retainer 70 and pull release ring 68 are forced downward along the outer wall surface of release mandrel 80 until pull release ring 68 no longer restricts movement of mandrel release member 66. Mandrel release member 66, therefore, disengages from the outer wall surface of inner mandrel 50 so that lower anchor connector 64 can slide downward along the outer wall surface of inner mandrel 50 and, thus, retract anchors 60 away from the inner wall surface of the wellbore. Inflatable can then be released by anchor assembly 30. Thus, because anchor assembly 30 is no longer secured to the wellbore or inflatable 24, downhole tool string 10 can be removed from the wellbore.

Alternatively, inflatable 24 could be deflated, e.g., after subsequent operation of another downhole tool, by additional application of tension, such as over-riding the stroke of force compensator 110. Downhole tool string 10 and, thus, anchor assembly 30 could then be retrieved with inflatable 24 still secured to downhole tool string 10.

In embodiments in which a hydraulic disconnect 22 is disposed between anchor assembly 30 and inflatable 24, the hydraulic disconnect 22 is designed to release the inflatable 24 when a slightly higher pressure is reached within upper bore 39 and lower bore 41 than the pressure within bore 39 required to activate mandrel release member 66. Therefore, anchor assembly 30 is released from the wellbore and, upon a slight increase in pressure within lower bore 41 by continued reciprocation of low pressure pump 16 and/or high pressure pump 18, hydraulic disconnect 22 is released from inflatable 24 so that downhole tool string 10 can be retrieved from the wellbore.

Figure 5A:
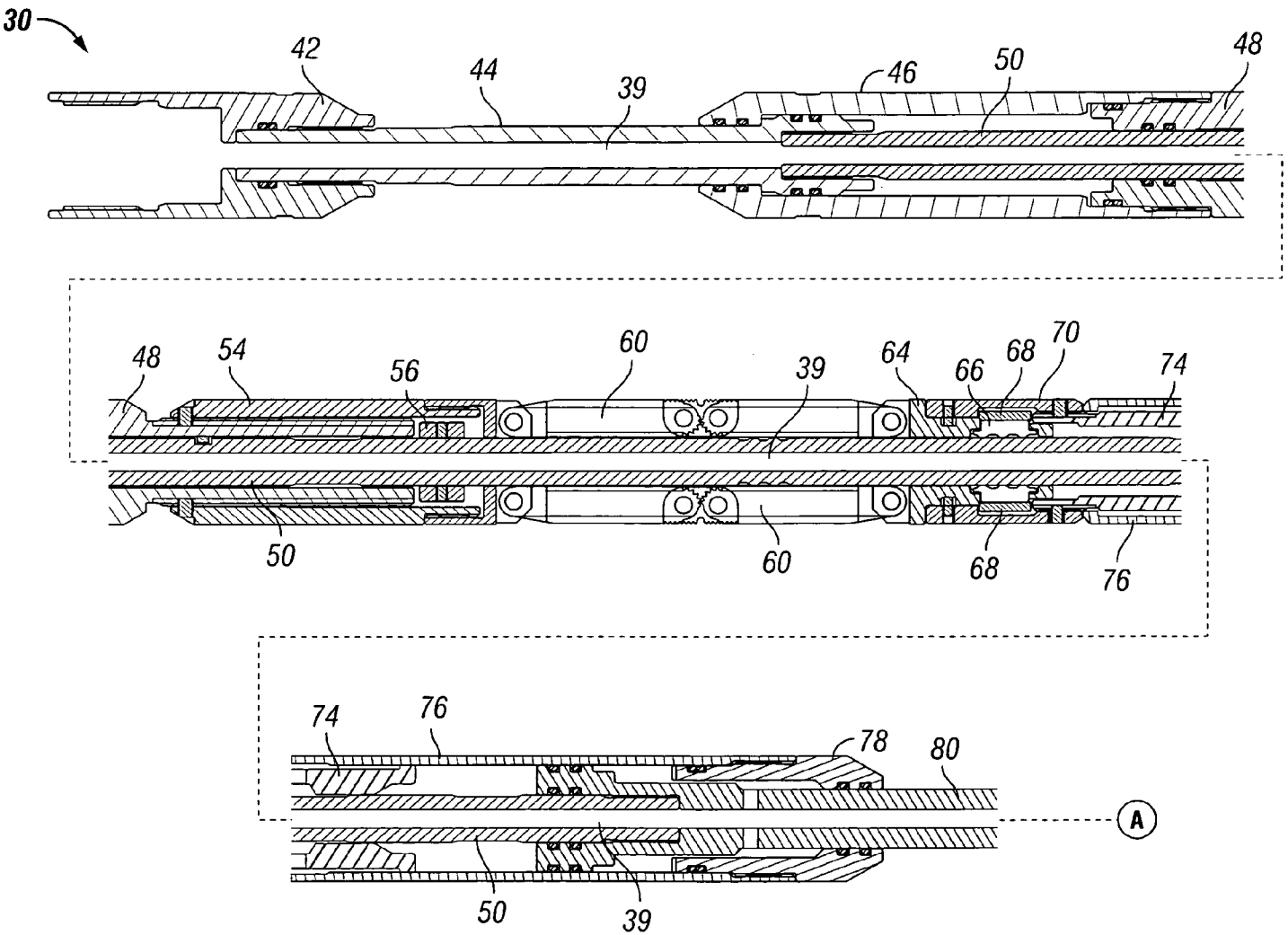
FIGS. 5A-5B is a partial cross-sectional view of the embodiment of the anchor assembly of FIGS. 2-4 shown in an emergency disconnect position.
Figure 5B:
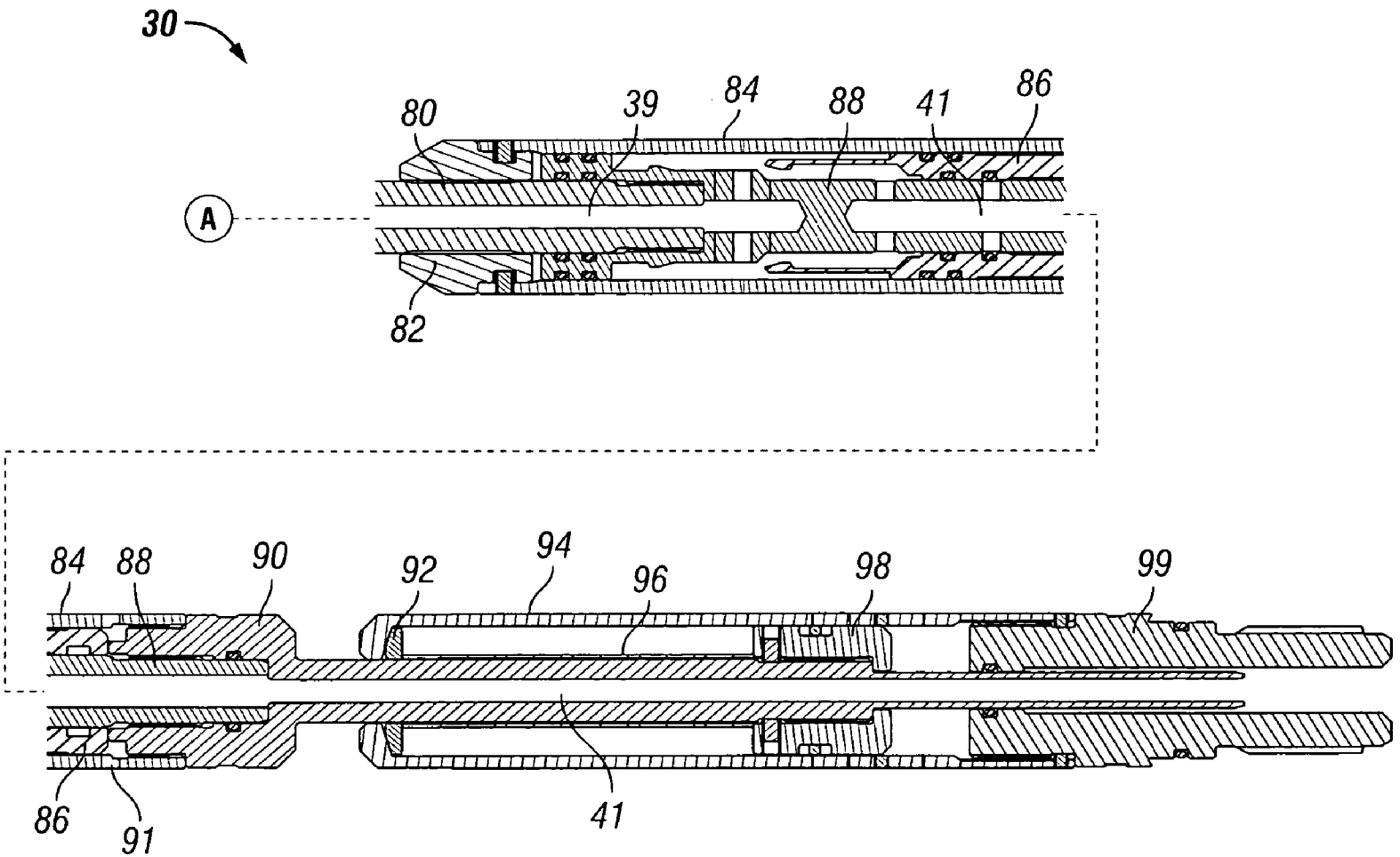

Referring now to FIGS. 5A-5B, anchor assembly 30 is shown in the emergency disconnect position. Mandrel release member 66 and pull release ring 68 permit the operator to release shear ring retainer 70 from lower anchor connector 64 in the event inflatable 24 fails or some other failure occurs in anchor assembly 30 or within downhole tool string 10 such that sufficient fluid pressure cannot be achieved to cause shear screw 72 to break. If such an event were to occur, and there was no emergency release member 66 and pull release ring 68, then anchors 60 would be permanently expanded into their set position and downhole tool string 10 would not be retrievable by pulling slickline 12.

As mentioned above, in the embodiment shown in FIGS. 2A-5B, mandrel release member 66 is a dog held in place by pull release ring 68. Pull release ring 68 is specially designed so that it will not compress, or hold, dog against inner mandrel 50 indefinitely. In one embodiment, pull release ring 68 includes one more longitudinal slots so that pull release ring 68 can hold a predetermined force. For example, pull release ring 68 may include 16 equally spaced longitudinal slots cut approximately 50% to 80% of the way through the thickness of pull release ring 68 such that pull release ring 68 can compress 12,000-15,000 psi of radially expanding force for an substantially indefinite period of time so that the dog is not allowed to expand prematurely; however, pull release ring 68 will break and release the dog if slickline is pulled upward with sufficient force. Thus, if anchor assembly 30, or some other component of downhole tool string 10 fails such that fluid pressure cannot build up sufficient to break shear screw 72, pull release ring 68 will fail due to the upward force exerted on slickline 12 so that the dog is free to radially expand. When the dog radially expands, inner mandrel 50 is released so that lower anchor connector 64, shear ring adapter 70, release sleeve adapter 74, and release sleeve piston 78 can slide downward along the outer wall surface of inner mandrel 50 and, thus, pull anchors 60 back toward the outer wall surface of inner mandrel 50.

It is to be understood that the invention is not limited to the exact details of construction, operation, exact materials, or embodiments shown and described as modifications and equivalents will be apparent to one skilled in the art. For example, crush tube 96 can be replaced by a series of Belleville washers (also know as a Belleville spring), a coiled spring, or any other similarly functioning compensator member. Additionally, compensator nut 98 is not required to provide resistive force for crush tube 96, the Belleville washers, or the coiled spring. Instead an inner shoulder disposed at the bottom end of compensator housing 94 can provide the resistive force. Moreover, low pressure pump and a high pressure pump can be replaced with a single pump capable of setting the inflatable, retracting the anchors and releasing the inflatable. Further, the release sleeve and the release piston and/or the inflation valve ring and the inflation valve housing can be a single component shaped to provide the structures described herein. In addition, connection of a component to another component is to be understood as including components being connected directly to and indirectly to other components so that one or more intervening components may be disposed between the two components, yet the two components are still deemed "connected to" one another. Moreover, wellbore fluid is not required to be used to create the pump pressure. Instead, fluid can be carried on the downhole tool string, such as in a reservoir so that the fluid is pumped from the reservoir down upper bore 39 and, subsequently, lower bore 41. Thus, the term "fluid" as used herein is to be understood as including fluid from the wellbore, as well as fluid from any other source. Accordingly, the invention is therefore to be limited only by the scope of the appended claims.

What is claimed is:

1. An anchor assembly comprising:

a mandrel having an upper end, a lower end, an outer wall surface, and a longitudinal bore disposed therethrough;

an anchor setting sub-assembly disposed at the upper end of the mandrel and operatively associated with the mandrel along the outer wall surface of the mandrel, the anchor setting sub-assembly comprising a hydrostatic pressure actuatable anchor;

an inflation sub-assembly disposed at the lower end of the mandrel and operatively associated with the mandrel along the outer wall surface of the mandrel, the inflation sub-assembly comprising a pump pressure actuatable valve having an opened position and a closed position, the opened position permitting fluid to flow through the bore of the mandrel; and an anchor release sub-assembly disposed between the anchor setting sub-assembly and the inflation sub-assembly and operatively associated with the anchor setting sub-assembly and the mandrel along the outer wall surface of the mandrel, the anchor release sub-assembly comprising a pump pressure actuatable mandrel release member, wherein hydrostatic pressure entering the bore of the mandrel actuates the anchor setting sub-assembly from a run-in position to a set position such that the anchor extends radially and engages an inner wall surface of a wellbore, a first positive pump pressure entering the bore of the mandrel actuates the valve of the inflation sub-assembly from the closed position to the opened position, and a second positive pump pressure entering the bore of the mandrel actuates the mandrel release member causing the anchor to retract from the set position to the run-in position, the second positive pump pressure being greater than the first positive pump pressure and the first positive pump pressure being greater than the hydrostatic pressure.

2. The anchor assembly of claim 1, wherein the hydrostatic pressure actuatable anchor comprises a piston housing in sliding engagement with the outer wall surface of the mandrel.

3. The anchor assembly of claim 2, wherein the anchor release sub-assembly is releasably connected to the anchor setting sub-assembly by the mandrel release member.

4. The anchor assembly of claim 3, wherein the anchor release sub-assembly comprises a pull release ring and the mandrel release member comprises a dog, the pull release ring having a locked position preventing radial expansion of the dog and an opened position permitting the dog to radially expand and release the mandrel.

5. The anchor assembly of claim 1, wherein the anchor release sub-assembly comprises a release piston in sliding engagement with an outer wall surface of the mandrel.

6. The anchor assembly of claim 1, wherein the inflation sub-assembly comprises an inflation valve housing having an inflation valve upper end and an inflation valve lower end each of which being connected to the mandrel and the valve is an inflation valve sleeve in sliding engagement with an inner wall surface of the inflation valve housing and the outer wall surface of the mandrel.

7. The anchor assembly of claim 6, wherein the inflation valve sleeve comprises a collet.

8. The anchor assembly of claim 1, further comprising a force compensator operatively associated with the mandrel, the force compensator having a compensator housing in sliding engagement with the mandrel.

9. The anchor assembly of claim 8, wherein the compensator housing includes a chamber formed by an inner wall surface of the compensator housing and the outer wall surface of the mandrel, the chamber having a compensation member disposed therein.

10. The anchor assembly of claim 9, wherein the compensation member is a crush tube.

11. An anchor assembly comprising:

an anchor setting sub-assembly, the anchor setting sub-assembly comprising a piston housing having an upper piston housing end and a lower piston housing end, the upper piston housing end being in sliding engagement with an outer wall surface of a mandrel having a bore, and the lower piston housing end being connected to an upper anchor connector, and an anchor having a slip surface, the anchor having an extended position and a retracted position, the anchor being connected to the upper anchor connector and being connected to the lower anchor connector;

an anchor release sub-assembly operatively associated below the anchor setting sub-assembly, the anchor release sub-assembly comprising a release piston having an upper release piston end and a lower release piston end, the lower release piston end being in sliding engagement with the mandrel and the upper release piston end being connected to a release sleeve, a release sleeve adapter disposed within a chamber formed by an inner wall surface of the release sleeve and the outer wall surface of the mandrel, the release sleeve adapter being in sliding engagement with the outer wall surface of the mandrel and having an upper release sleeve adapter end connected to a mandrel release member, the mandrel release member being operatively associated with the lower anchor connector; and an inflation sub-assembly operatively associated below the anchor release sub-assembly, the inflation sub-assembly comprising an inflation valve housing having an inflation valve upper end and an inflation valve lower end each of which being connected to the mandrel and an inflation valve sleeve in sliding engagement with an inner wall surface of the inflation valve housing and with the outer wall surface of the mandrel, the inflation valve sleeve having an opened position and a closed position, the opened position allowing fluid flow through the bore of the mandrel and the closed position preventing fluid flow through the bore of the mandrel.

12. The anchor assembly of claim 11, wherein the mandrel comprises an upper mandrel, an inner mandrel, a release mandrel, an inflation valve mandrel, and a lower mandrel, each of the upper mandrel, the inner mandrel, the release mandrel, the inflation valve mandrel, and the lower mandrel being separate components operatively associated with each other to form the bore of the mandrel.

13. The anchor assembly of claim 12, wherein the inflation valve sleeve is in sliding engagement with the inflation valve mandrel and the inflation valve mandrel comprises an upper port in fluid communication with the bore of the mandrel and a lower port in fluid communication with the bore of the mandrel.

14. The anchor assembly of claim 13, wherein the inflation valve sleeve slides longitudinally along the inner wall surface of the inflation valve housing and along the outer wall surface of the inflation valve mandrel.

15. The anchor assembly of claim 11, further comprising a force compensator operatively associated with the mandrel below the inflation sub-assembly, the force compensator having a compensator housing in sliding engagement with the mandrel.

16. The anchor assembly of claim 15, wherein the compensator housing includes a chamber formed by an inner wall surface of the compensator housing and the outer wall surface of the mandrel, the chamber having a compensation member disposed therein.

17. The anchor assembly of claim 11, wherein the anchor release sub-assembly comprises a pull release ring and the mandrel release member comprises a dog, the pull release ring having a locked position preventing radial expansion of the dog and an opened position permitting the dog to radially expand and release the mandrel.

18. The anchor assembly of claim 11, wherein the inflation valve sleeve comprises a collet.

19. A method of setting an inflatable within a wellbore of a well using a slickline, the method comprising the steps of:

(a) running a downhole tool string on a slickline into a wellbore, the downhole tool string comprising a pump, a trigger, an anchor assembly, and an inflatable, the pump being disposed above the trigger, the trigger being disposed above the anchor assembly, and the anchor assembly being disposed above the inflatable;

(b) actuating the trigger allowing fluid to enter the anchor assembly and actuate the anchor assembly to radially expand an anchor from an anchor run-in position to an anchor set position in which the anchor engages an inner wall surface of the wellbore;

(c) reciprocating the slickline to pump fluid through the trigger and into the anchor assembly;

(d) actuating a valve operatively disposed within the anchor assembly with a valve actuating applied fluid pressure so that the fluid can flow from the anchor assembly and into the inflatable;

(f) reciprocating the slickline to pump fluid through the trigger, through the anchor assembly, and into the inflatable until the inflatable is set within the wellbore; and (g) actuating a release piston operatively disposed within the anchor assembly with a release piston actuating applied fluid pressure allowing retraction of the anchor from the anchor set position to the anchor retracted position.

20. The method of claim 19, wherein during step (f), a compensator member of the anchor assembly is forced downward to compensate for a reduction of an axial length of the inflatable as the inflatable inflates.

21. The method of claim 19, wherein the trigger is actuated by hydrostatic pressure.

* * * * *